US011557867B2

(12) United States Patent
Lv et al.

(10) Patent No.: US 11,557,867 B2
(45) Date of Patent: Jan. 17, 2023

(54) MODULAR ELECTRICAL CONNECTOR WITH COILS PROVIDING ELECTROMAGNETIC SHIELDING

(71) Applicant: DONGGUAN LEADER PRECISION INDUSTRY CO., LTD., Dongguan (CN)

(72) Inventors: Xiaolei Lv, Dongguan (CN); Bo Wang, Dongguan (CN); Xiao Kong, Dongguan (CN); Jinqi Li, Dongguan (CN)

(73) Assignee: DONGGUAN LEADER PRECISION INDUSTRY CO., LTD., Qingxi Town Dongguan (CN)

( * ) Notice: Subject to any disclaimer, the term of this patent is extended or adjusted under 35 U.S.C. 154(b) by 94 days.

(21) Appl. No.: 17/229,462

(22) Filed: Apr. 13, 2021

(65) Prior Publication Data

US 2021/0359476 A1 Nov. 18, 2021

(30) Foreign Application Priority Data

May 12, 2020 (CN) ..... 202010400361.0

(51) Int. Cl.
*H01R 24/64* (2011.01)
*H01R 12/71* (2011.01)
(Continued)

(52) U.S. Cl.
CPC ..... *H01R 24/64* (2013.01); *H01R 12/716* (2013.01); *H01R 13/514* (2013.01);
(Continued)

(58) Field of Classification Search
CPC .... H01R 24/64; H01R 12/716; H01R 13/514; H01R 13/658; H01R 13/6581; H01R 13/6633; H01R 13/665; H01R 13/719; H01R 27/02; H01R 13/6625; H01R 13/6658; H01R 13/7193; H01R 24/62
See application file for complete search history.

(56) References Cited

FOREIGN PATENT DOCUMENTS

CN 1731628 A 2/2006
CN 2791955 Y 6/2006
(Continued)

OTHER PUBLICATIONS

Office Action issued in CN Application No. 202010400361.0 dated Jan. 22, 2021.

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

A modular connector includes a housing, a circuit board located in the housing, a connector assembly connected to the circuit board, and a coil module mounted to the circuit board. The connector assembly includes a number of conductive terminals. The coil module includes a first coil module and a second coil module. The first coil module includes a number of first coils and a number of first coil groups. The second coil module includes a second coil. The second coil is divided into a number of second coil groups along its circumference. The first coil groups and corresponding second coil groups are coupled, thereby improving the electromagnetic shielding effect of the modular connector.

20 Claims, 13 Drawing Sheets

(51) Int. Cl.

| | |
|---|---|
| ***H01R 13/514*** | (2006.01) |
| ***H01R 13/6581*** | (2011.01) |
| ***H01R 13/66*** | (2006.01) |
| ***H01R 13/719*** | (2011.01) |
| ***H01R 27/02*** | (2006.01) |
| ***H01R 13/658*** | (2011.01) |
| *H01R 24/62* | (2011.01) |
| *H01R 13/7193* | (2011.01) |

(52) U.S. Cl.
CPC ..... *H01R 13/658* (2013.01); *H01R 13/6581* (2013.01); *H01R 13/665* (2013.01); *H01R 13/6633* (2013.01); *H01R 13/719* (2013.01); *H01R 27/02* (2013.01); *H01R 13/6625* (2013.01); *H01R 13/6658* (2013.01); *H01R 13/7193* (2013.01); *H01R 24/62* (2013.01)

(56) References Cited

FOREIGN PATENT DOCUMENTS

| | | | | |
|---|---|---|---|---|
| CN | 201285980 | Y | * | 8/2009 |
| CN | 101908682 | A | | 12/2010 |
| TW | 201411957 | A | | 3/2014 |
| TW | M517432 | U | | 2/2016 |
| TW | I558828 | B | | 11/2016 |

* cited by examiner

MODULAR ELECTRICAL CONNECTOR WITH COILS PROVIDING ELECTROMAGNETIC SHIELDING

CROSS-REFERENCE TO RELATED APPLICATION

This patent application claims priority of a Chinese Patent Application No. 202010400361.0, filed on May 12, 2020 and titled "Modular connector", the entire content of which is incorporated herein by reference.

TECHNICAL FIELD

The present disclosure relates to a modular connector which belongs to a technical field of electrical connectors.

BACKGROUND

In order to improve the shielding effect of connectors, some existing RJ45 connectors include coil modules. In general, there are two types of coil modules. One type of the coil modules has eight coils and the other type of the coil modules has twelve coils. Each coil includes a ring-shaped magnetic body and a coil wire wound on the ring-shaped magnetic body. In other words, one type of the existing coils has eight ring-shaped magnetic bodies and eight coil wires, and the other type of the existing coil modules has twelve ring-shaped magnetic bodies and twelve coil wires. However, the electromagnetic shielding effect of the coil module with eight coils is general, which is not suitable for applications with strict electromagnetic shielding requirements. The coil module with twelve coils is generally composed of eight coils and four coils. Although it can achieve a better electromagnetic shielding effect, the cost is higher.

SUMMARY

An object of the present disclosure is to provide a modular connector with lower cost and better electromagnetic shielding effect.

In order to achieve the above object, the present disclosure adopts the following technical solution: a modular connector, comprising a housing; a circuit board located in the housing; a connector assembly electrically connected to the circuit board, the connector assembly comprising a plurality of conductive terminals extending obliquely; and a coil module mounted to the circuit board; wherein the coil module comprises a first coil module and a second coil module, the first coil module comprises a plurality of first coils and a plurality of first coil groups, and each first coil group is formed by two first coils; and wherein the second coil module comprises a second coil, the second coil is divided into a plurality of second coil groups along a circumference thereof, and the first coil groups are coupled with corresponding second coil groups.

In order to achieve the above object, the present disclosure adopts the following technical solution: a modular connector, comprising a housing; a circuit board located in the housing; a connector assembly comprising a plurality of conductive terminals electrically connected to the circuit board; and a coil module mounted to the circuit board; wherein the coil module comprises a first coil module and a second coil module, the first coil module comprises a plurality of first coils and a plurality of first coil groups, and each first coil group is formed by two adjacent first coils; and wherein the second coil module comprises a single second coil, the second coil is divided into a plurality of second coil groups along a circumference thereof, numbers of the second coil groups and the first coil groups are the same, and the first coil groups and second coil groups are coupled so as to improve electromagnetic shielding effect of the modular connector.

Compared with the prior art, the coil module of the present disclosure includes a first coil module and a second coil module. The first coil module includes a plurality of first coil groups each of which is composed of a first coil and a second coil. The second coil module includes a plurality of second coil groups distributed along a circumference of a third magnetic body. Through the coupling of the first coil groups and the corresponding second coil groups, the electromagnetic shielding effect of the modular connector is improved. In addition, by distributing the second coil groups along the circumference of the third magnetic body, a diameter of the third magnetic body can be set to be relatively large, thereby facilitating winding, facilitating manufacturing and reducing cost.

DETAILED DESCRIPTION

Figure 1:
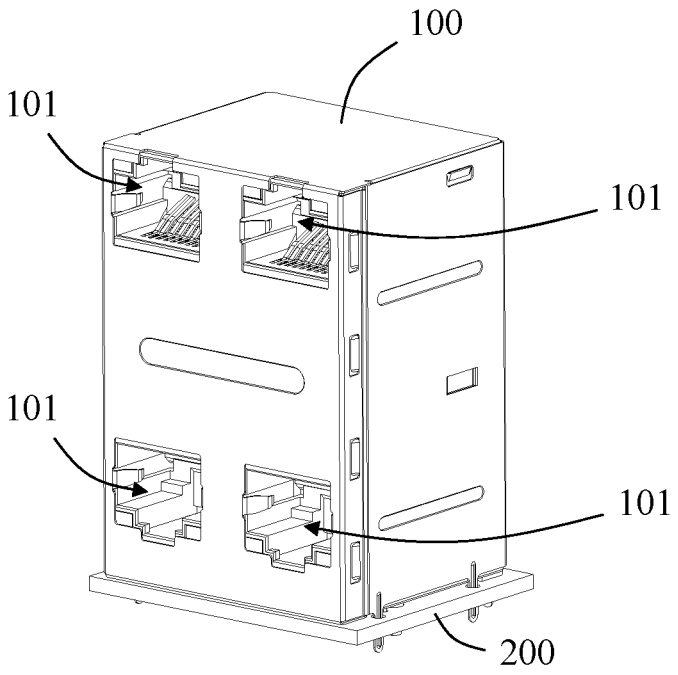
FIG. 1 is a schematic perspective view of a modular connector when mounted on a circuit board in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 2:
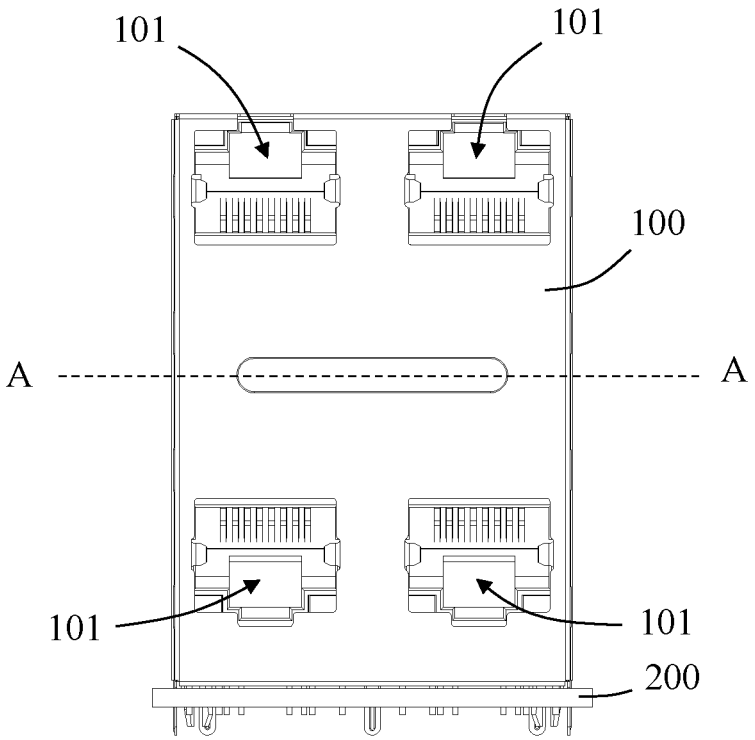
FIG. 2 is a front view of FIG. 1.
Figure 3:
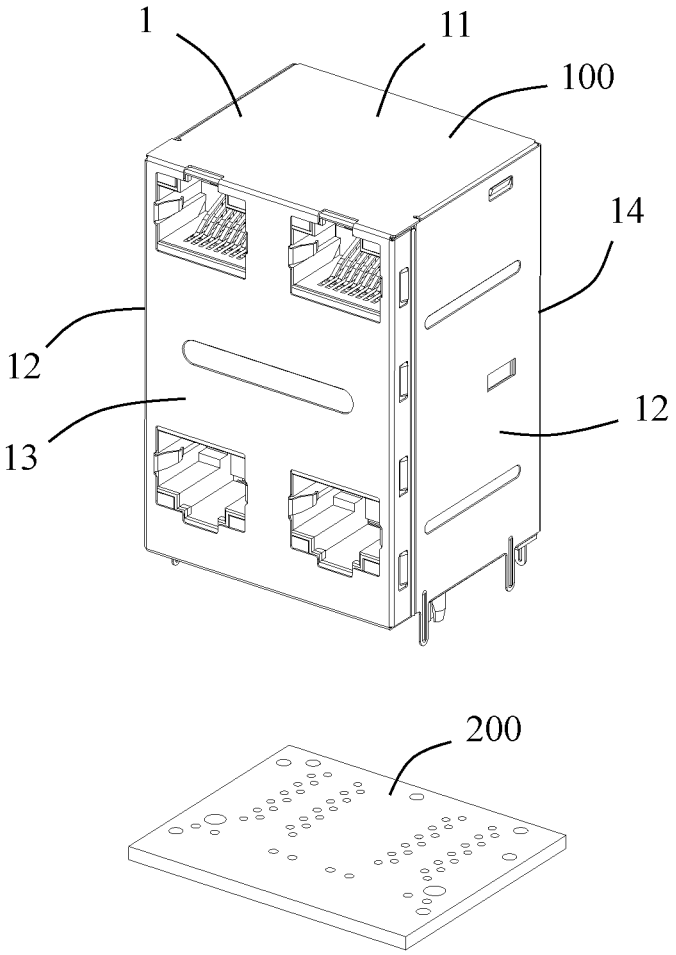
FIG. 3 is a partially exploded perspective view of FIG. 1.

Referring to FIGS. 1 to 3, an embodiment of the present disclosure discloses a modular connector 100 for being mounted on a bottom circuit board 200. In the illustrated embodiment of the present disclosure, the modular connector 100 is a RJ45 board-end connector which can be applied to occasions with high electromagnetic shielding requirements. The modular connector 100 includes four ports 101 arranged in two rows and two columns. In the illustrated embodiment of the present disclosure, two ports 101 located in an upper row and two ports 101 located in a lower row are symmetrically arranged along a horizontal plane A-A which is located between the upper row and the lower row (referring to FIG. 2).

Figure 4:
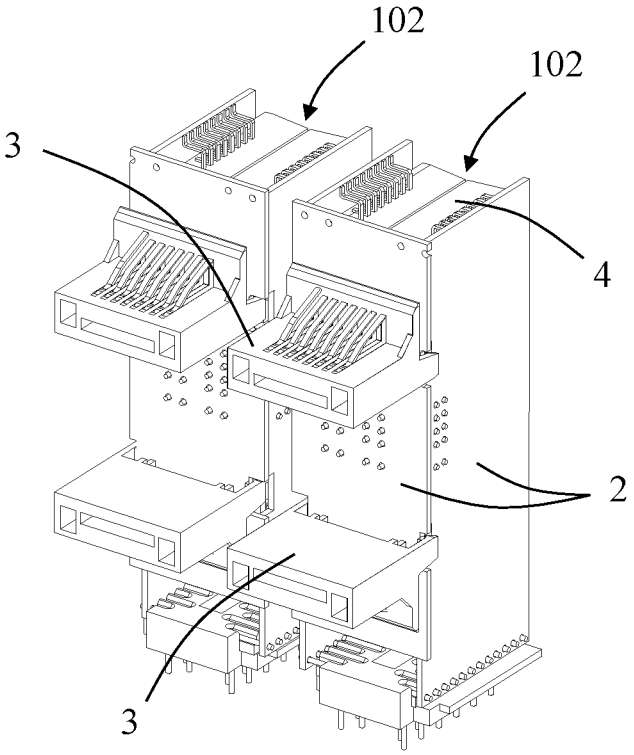
FIG. 4 is a perspective view of the modular connector in accordance with an embodiment of the present disclosure after a housing and a part of the insulation body are removed.

Referring to FIGS. 3 and 4, the modular connector 100 includes a housing 1, a circuit board located in the housing 1, a connector assembly 3 connected to the circuit board 2, and a coil module 4 mounted to the circuit board 2.

The housing 1 includes an outer shell made of a metal material in order to achieve a certain degree of electromagnetic shielding function. In the illustrated embodiment of the present disclosure, the housing 1 includes a top wall 11, two side walls 12, a front wall 13 and a rear wall 14. The four ports 101 are all exposed on the front wall 13.

Figure 5:
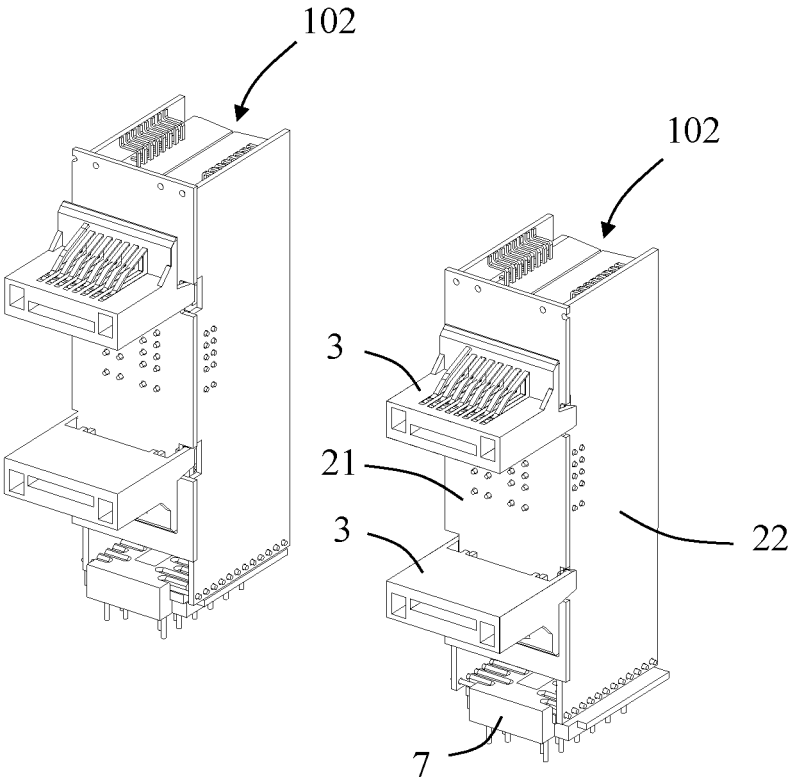
FIG. 5 is a partially exploded perspective view of FIG. 4.

Referring to FIGS. 4 and 5, the modular connector 100 of the present disclosure includes two modules 102 which are arranged side by side and have the same structure. The following takes only one of the two modules 102 as an example for detailed description.

Figure 6:
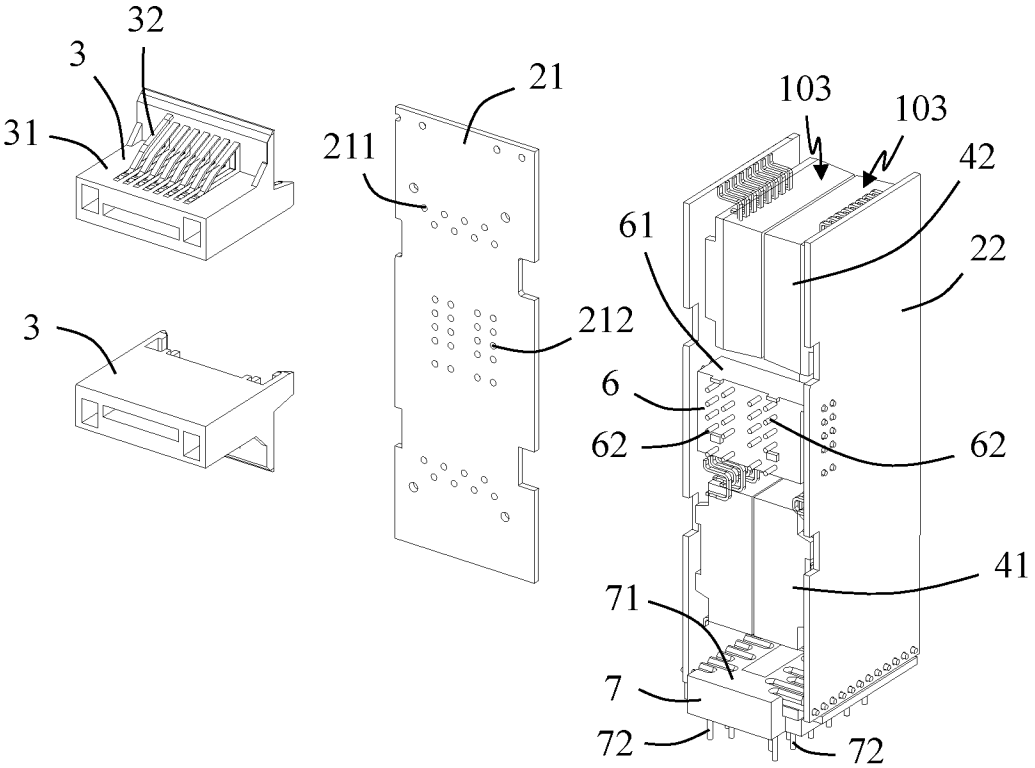
FIG. 6 is a partially exploded perspective view of one of the modules in FIG. 5.

Referring to FIGS. 5 and 6, the module 102 includes two connector assemblies 3 arranged one above the other, a first circuit board 21 for mounting the two connector assemblies 3, a transfer module 6 electrically connected to the first circuit board 21, two circuit board modules 103 electrically connected to both sides of the transfer module 6 respectively, and a mounting module 7 used to connect the two circuit board modules 103 to the bottom circuit board 200. In the illustrated embodiment of the present disclosure, the two circuit board modules 103 are symmetrically arranged along a vertical plane located therebetween.

Each connector assembly 3 includes a connector body 31 and a plurality of conductive terminals 32 fixed to the connector body 31. The conductive terminals 32 extend obliquely in the port 101. In the illustrated embodiment of the present disclosure, the number of conductive terminals 32 of each connector assembly 3 is eight.

The first circuit board 21 includes a plurality of first conductive holes 211 electrically connected to the connector assembly 3 and a plurality of second conductive holes 212 connected to the first conductive holes 211 through conductive paths (not shown).

Figure 7:
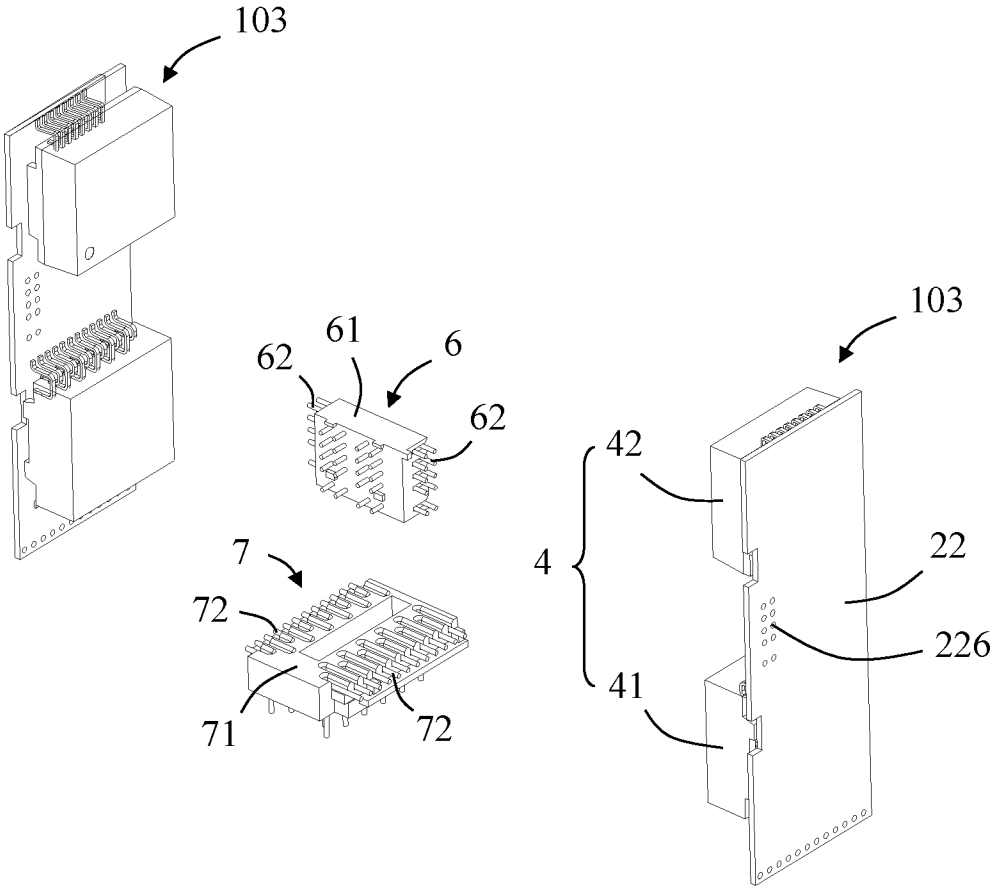
FIG. 7 is a partial exploded perspective view of a circuit board module formed by removing a connector assembly and a first circuit board in FIG. 6.

Referring to FIG. 7, the transfer module 6 includes a transfer insulation body 61 and a plurality of transfer terminals 62 fixed in the transfer insulation body 61. The transfer terminals 62 are divided into two groups each of which is L-shaped. One group of the transfer terminals 62 is used to connect a circuit board module 103 (for example, the circuit board module 103 on the left side in FIG. 7) to the first circuit board 21, and the other group of the transfer terminals 62 is used to connect another circuit board module 103 (for example, the circuit board module 103 on the right side in FIG. 7) to the first circuit board 21.

The mounting module 7 includes a mounting insulation body 71 and a plurality of mounting terminals 72 fixed in the mounting insulation body 71. The mounting terminals 72 are divided into two groups each of which is L-shaped. One group of the mounting terminals 72 is used to connect one circuit board module 103 to the bottom circuit board 200, and the other group of the mounting terminals 72 is used to connect the other circuit board module 103 to the bottom circuit board 200.

Figure 8:
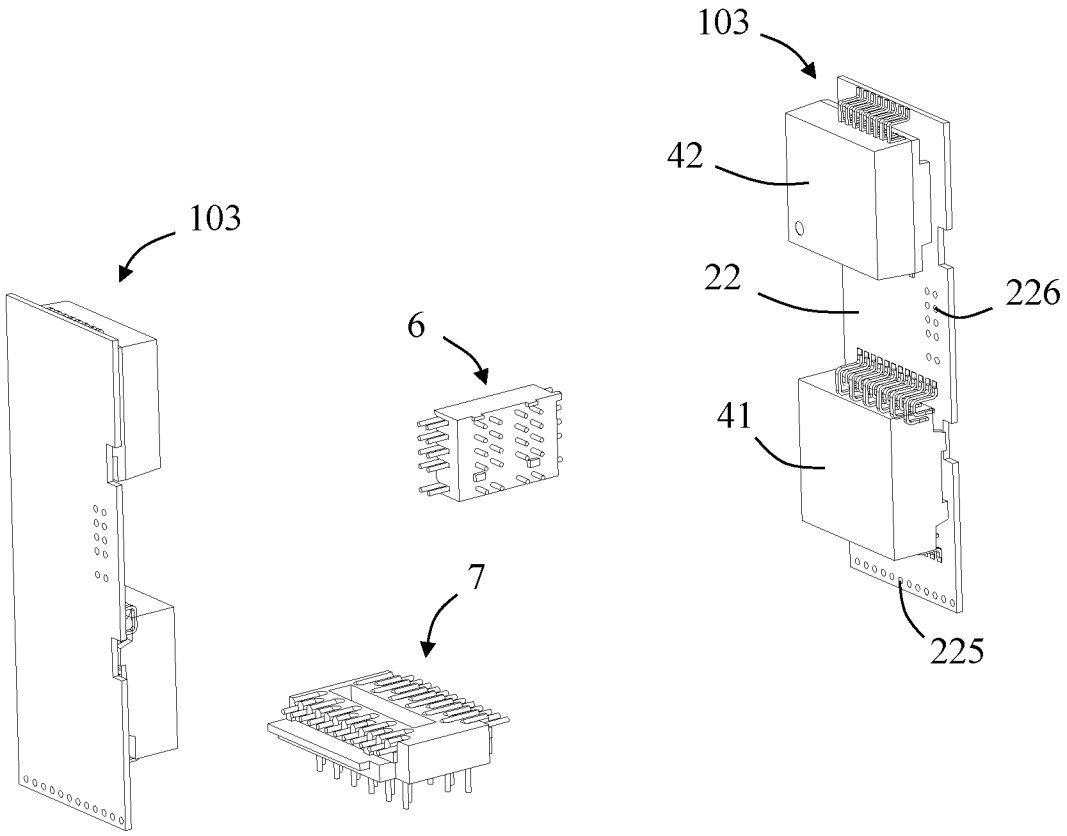
FIG. 8 is an exploded perspective view of FIG. 7 from another angle.

Referring to FIGS. 7 and 8, since the two circuit board modules 103 are symmetrically arranged, only one of the two circuit board modules 103 is taken as an example for detailed description.

Figure 9:
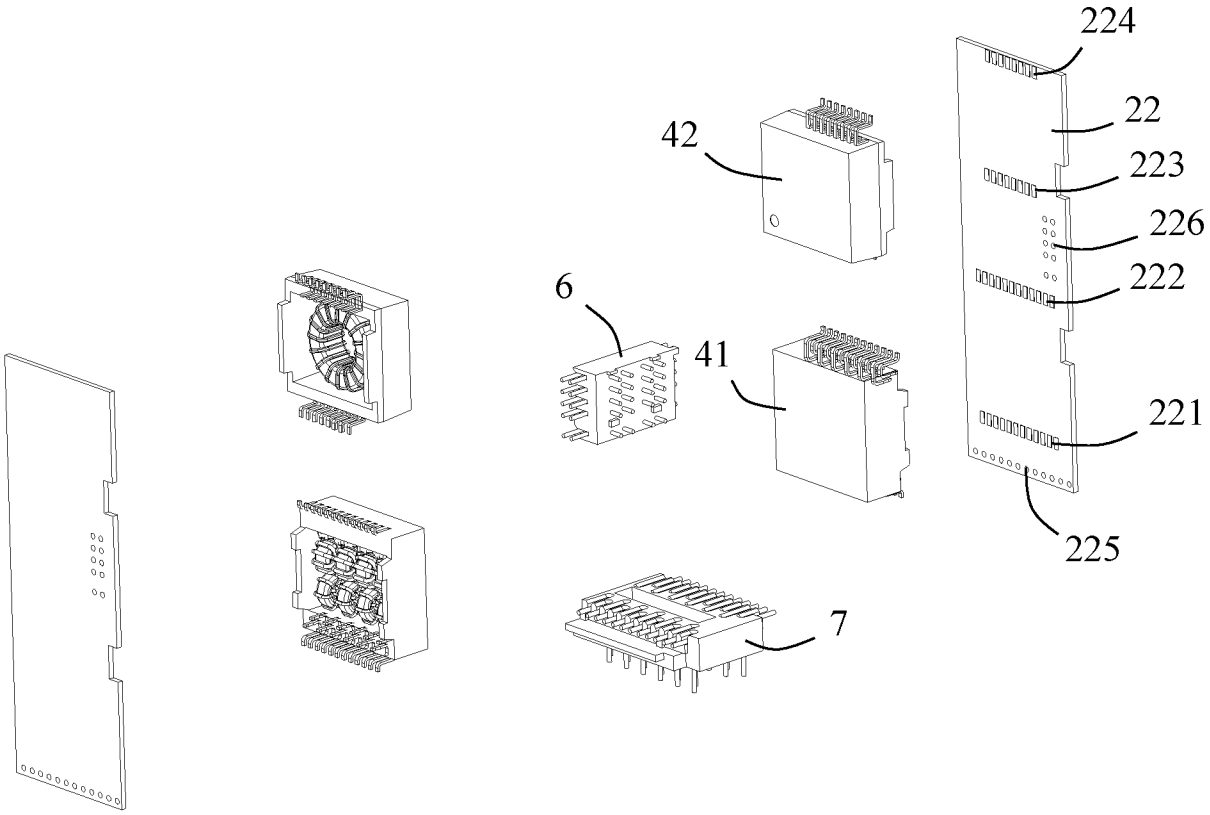
FIG. 9 is a further perspective exploded view of FIG. 8.
Figure 10:
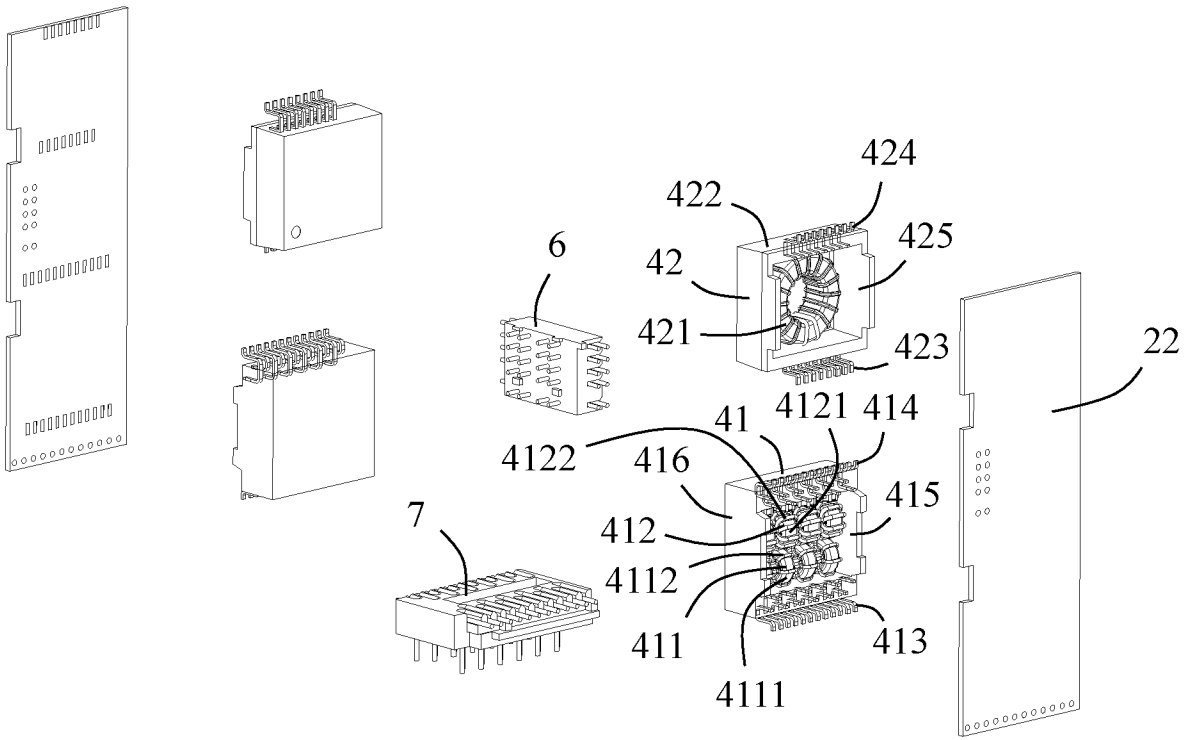
FIG. 10 is an exploded perspective view of FIG. 9 from another angle.

Referring to FIGS. 9 and 10, the circuit board module 103 includes a second circuit board 22, a first coil module 41 and a second coil module 42 which are mounted on the second circuit board 22. The circuit board 2 includes the first circuit board 21 and the second circuit board 22. The coil module 4 includes the first coil module 41 and the second coil module 42.

Figure 11:
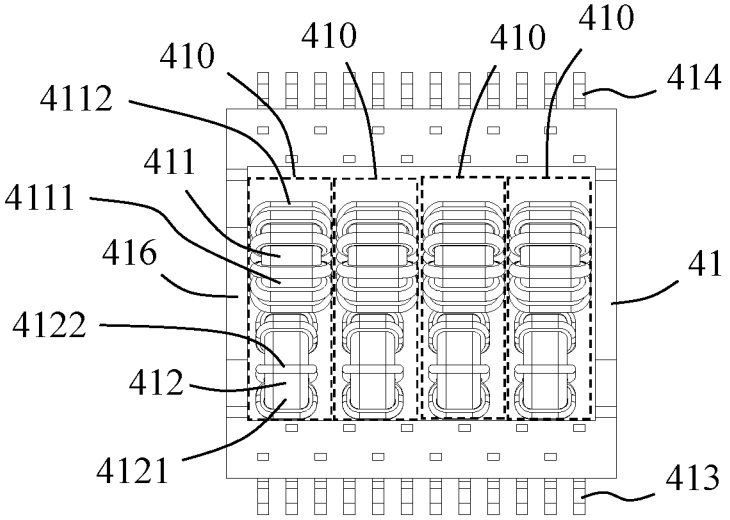
FIG. 11 is a side view of a first coil module.
Figure 13:
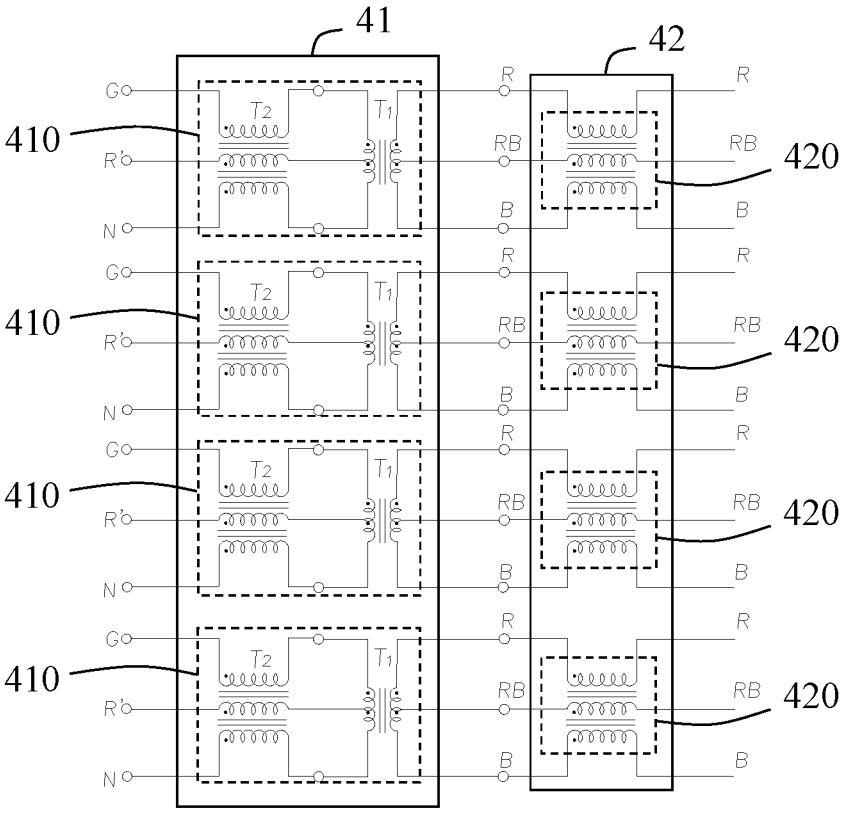
FIG. 13 is a schematic view of a coupling between the first coil module and the second coil module in accordance with an embodiment of the present disclosure.

Referring to FIGS. 10, 11 and 13, the first coil module 41 includes a plurality of first coils 411, a plurality of second coils 412, a first housing 416 for receiving the first coils 411 and the second coils 412, a plurality of first soldering portions 413 located on one side of the first housing 416 and a plurality of second soldering portions 414 located on the other side of the first housing 416. In the illustrated embodiment of the present disclosure, the first housing 416 is substantially of a cuboid shape. The first housing 416 includes a first receiving space 415 for receiving the first coils 411 and the second coils 412. Each first coil 411 includes a ring-shaped first magnetic body 4111 and a first coil wire 4112 wound on the ring-shaped first magnetic body 4111. Each second coil 412 includes a ring-shaped second magnetic body 4121 and a second coil wire 4122 wound on the ring-shaped second magnetic body 4121. Input ends of the first coil wire 4112 are connected to the first soldering portions 413, and output ends of the second coil wires 4122 are connected to the second soldering portions 414. A plurality of first coil groups 410 are formed, in which each first coil group 410 is formed by one first coil 411 and one second coil 412. The one first coil 411 and the one second coil 412 of the first coil group 410 may be the same coil or different coils. For example, the inductance of the coils is the same or different. In the illustrated embodiment of the present disclosure, there are four first coils 411 and four second coils 412 of the first coil module 41. Correspondingly, the first coil groups 410 have four groups. Of course, in other embodiments, the first coil groups 410 may also be five groups etc.

Figure 12:
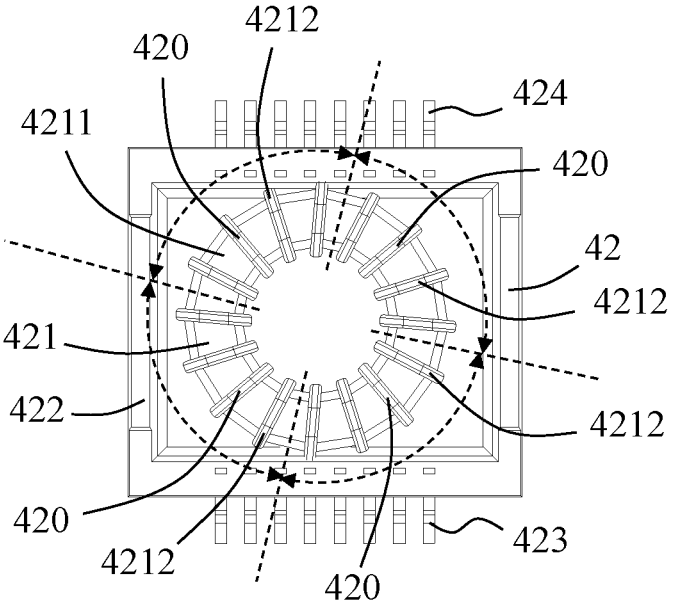
FIG. 12 is a side view of a second coil module.

Referring to FIGS. 10, 12 and 13, the second coil module 42 includes a third coil 421, a second housing 422 for receiving the third coil 421, a plurality of third soldering portions 423 located on one side of the second housing 422 and a plurality of fourth soldering portions 424 located on the other side of the second housing 422. In the illustrated embodiment of the present disclosure, the first housing 416 and the second housing 422 are spaced apart from each other in a vertical direction. The second housing 422 is substantially of a cuboid shape. The second housing 422 includes a second receiving space 425 for receiving the third coil 421. As shown in FIGS. 10 and 12, the third coil 421 includes a single third magnetic body 4211 and a plurality of third coil wires 4212 wound on the third magnetic body 4211. In the illustrated embodiment of the present disclosure, the third magnetic body 4211 is generally of a ring-shaped configuration. Input ends of the third coil wires 4212 are connected to the third soldering portions 423, and output ends of the third coil wires 4212 are connected to the fourth soldering portions 424. In the illustrated embodiment of the present disclosure, the second coil module 42 has only one third coil 421. The third coil 421 is divided into a plurality of second coil groups 420 along a circumference of the third magnetic body 4211. In other words, each second coil group 420 includes one third coil wire 4212 and a part of the third magnetic body 4211 on which the third coil wire 4212 is wound. In the illustrated embodiment of the present disclosure, there are four second coil groups 420 disposed along the circumference of the third magnetic body 4211. The first coil groups 410 and the corresponding second coil groups 420 are coupled. Specifically, in the illustrated embodiment of the present disclosure, the second coil groups 420 have four groups which do not overlap.

Figure 14:
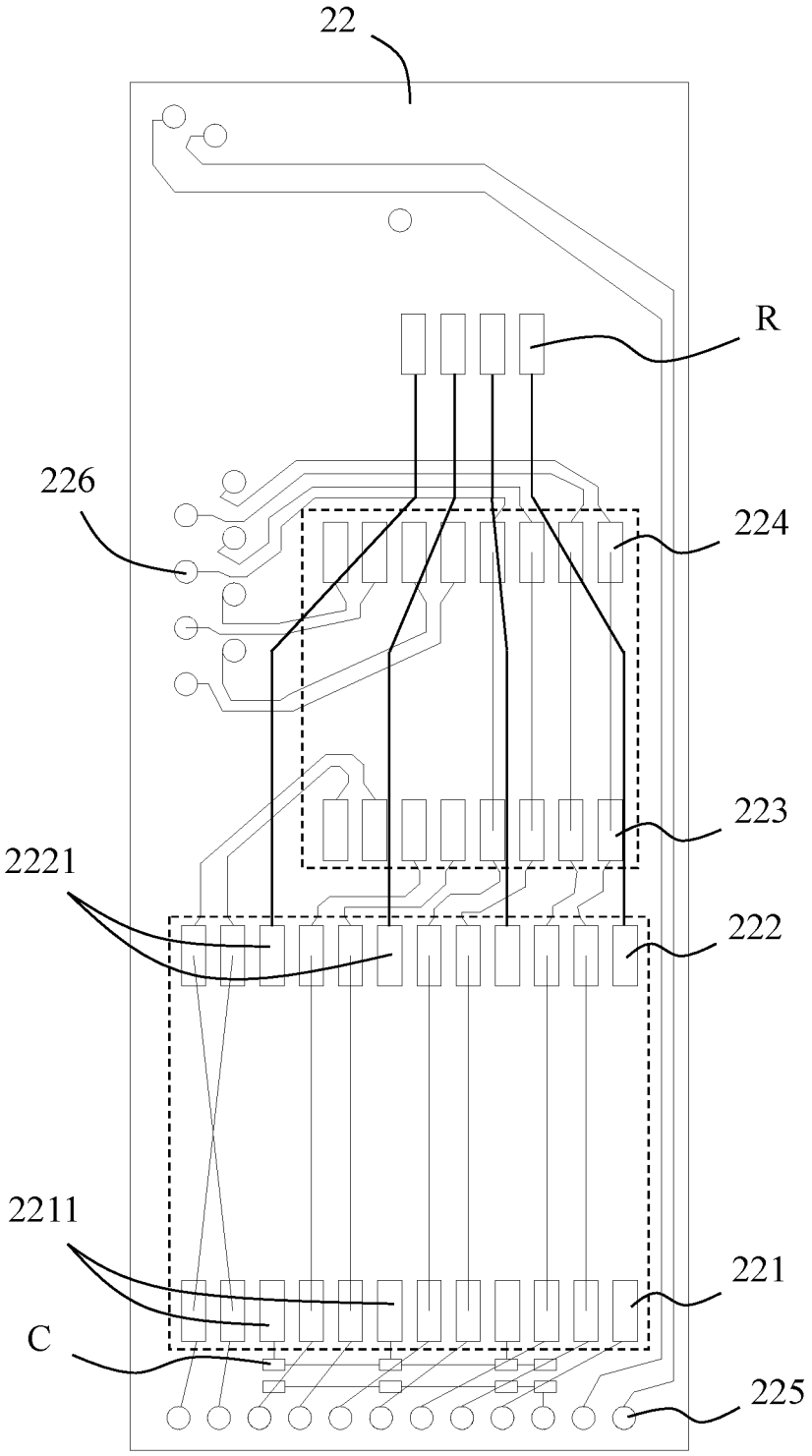
FIG. 14 is a schematic view of a second circuit board.

Referring to FIG. 14, the second circuit board 22 includes a plurality of first golden fingers 221 electrically connected to the first soldering portions 413, a plurality of second golden fingers 222 electrically connected to the second soldering portions 414, a plurality of third golden fingers 223 electrically connected to the third soldering portions 423, and a plurality of fourth golden fingers 224 electrically connected to the fourth soldering portions 424.

Numbers of the first golden fingers 221 and the second golden fingers 222 are both twelve, and numbers of the third golden fingers 223 and the fourth golden fingers 224 are both eight. The twelve first golden fingers 221 include four groups and a plurality of first pads 2211 each of which is located between adjacent two groups of the first golden fingers 221. Each group of the first golden fingers 221 includes two adjacent first golden fingers 221. The first pads 2211 are connected to capacitors C. The twelve second golden fingers 222 include four groups and a plurality of second pads 2221 each of which is located between adjacent two groups of the second golden fingers 222. Each group of the second golden fingers 222 includes two adjacent second golden fingers 222. Each group of the third golden fingers 223 and a corresponding group of the second golden fingers 222 are connected through conductive paths of the second circuit board 22. The second pads 2221 are connected to resistors R of the second circuit board 22. The eight third golden fingers 223 are divided into four groups, in which each group includes two adjacent third golden fingers 223. The eight fourth golden fingers 224 are divided into four groups, in which each group includes two adjacent fourth golden fingers 224. Each group of the fourth golden fingers 224 is connected to the third conductive holes 225 for mounting the transfer terminals 62 through conductive paths of the second circuit board 22.

In use, the signal on the bottom circuit board 200 is input to the third conductive holes 225 of the second circuit board 22 through the mounting module 7, the third conductive holes 225 transmit the signal to the first golden fingers 221 through coupling, and the first golden fingers 221 are connected to the second golden fingers 222 through the first coil module 41 so as to filter the signal. Then, the second golden fingers 222 are further connected to the third golden fingers 223. After the signal is filtered by the second coil module 42, the signal is transmitted to the first golden fingers 221. In this process, the input signal is filtered by the first coil groups 410 and the second coil groups 420, which improves the quality of signal transmission. Then, the signal is transmitted to the fourth conductive holes 226 which are connected to the first golden fingers 221 (referring to FIG. 14), and the signal is transmitted to the ports 101 through the transfer module 6, the first circuit board 21 and the connector assemblies 3.

Compared with the prior art, the coil module 4 of the present disclosure includes the first coil module 41 and the second coil module 42. The first coil module 41 includes the plurality of first coils 411, the plurality of second coils 412, and the plurality of first coil groups 410 each of which is formed by one first coil 411 and one second coil 412. The second coil module 42 includes a plurality of second coil groups 420 distributed along the circumference of the third magnetic body 4211. Through the coupling of the first coil groups 410 and the corresponding second coil groups 420, the electromagnetic shielding effect of the modular connector 100 is improved.

Firstly, compared to the coil module with twelve coils composed of eight coils and four coils in the prior art, the number of coils disclosed in the present disclosure is nine (i.e., four first coils 411, four second coils 412 and one third coil 421) reduces the number of coils on the premise of achieving the same shielding effect. Secondly, in the present disclosure, by installing the first coils 411 and the second coils 412 in the first housing 416 and by installing the third coil 421 in the second housing 422, respectively, on the one hand, it can be shared with the existing eight-coil mold for saving the cost; on the other hand, it is convenient to arrange the coils. Thirdly, by distributing the plurality of second coil groups 420 along the circumference of the single third magnetic body 4211, the diameter of the third magnetic body 4211 can be set to be relatively large, thereby facilitating winding, facilitating manufacturing and reducing cost.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A modular connector, comprising:

a housing;

a circuit board located in the housing;

a connector assembly electrically connected to the circuit board, the connector assembly comprising a plurality of conductive terminals extending obliquely; and a coil module mounted to the circuit board;

wherein the coil module comprises a first coil module and a second coil module, the first coil module comprises a plurality of first coils and a plurality of second coils, a plurality of first coil groups are formed, and each first coil group is formed by one first coil and one second coil;

wherein each first coil comprises a first magnetic body and a first coil wire wound on the first magnetic body, and each second coil comprises a second magnetic body and a second coil wire wound on the second magnetic body; and wherein the second coil module comprises a third coil, the third coil comprises a third magnetic body and a plurality of third coil wires wound on the third magnetic body, the third coil is divided into a plurality of second coil groups along a circumference of the third magnetic body, and the first coil groups are coupled with corresponding second coil groups.

2. The modular connector according to claim 1, wherein the first coil module comprises four first coils and four second coils, the second coil module comprises only one third coil, and both the first coil groups and the second coil groups comprise four groups.

3. The modular connector according to claim 1, wherein the circuit board comprises a first circuit board and a second circuit board perpendicular to the first circuit board, the connector assembly is mounted to the first circuit board, and the coil module is mounted to the second circuit board.

4. The modular connector according to claim 3, further comprising a transfer module electrically connecting the first circuit board and the second circuit board, the transfer module comprising a transfer insulation body and a plurality of transfer terminals fixed to the transfer insulation body, one end of the transfer terminals being connected to the first circuit board, and the other end of the transfer terminals being connected to the second circuit board.

5. The modular connector according to claim 1, wherein the first coil module comprises a first housing, and the first housing comprises a first receiving space in which the plurality of first coils and the plurality of the second coils are received; and wherein the second coil module comprises a second housing, and the second housing comprises a second receiving space in which the third coil is received.

6. The modular connector according to claim 5, wherein the first housing and the second housing are spaced apart from each other in a vertical direction.

7. The modular connector according to claim 5, wherein the first coil module comprises a plurality of first soldering portions located on one side of the first housing and a plurality of second soldering portions located on the other side of the first housing;

wherein input ends of the first coil wires are connected to the first soldering portions, output ends of the second coil wires are connected to the second soldering portions; and wherein the circuit board comprises a plurality of first golden fingers electrically connected to the first soldering portions and a plurality of second golden fingers electrically connected to the second soldering portions.

8. The modular connector according to claim 7, wherein the second coil module comprises a plurality of third soldering portions located on one side of the second housing and a plurality of fourth soldering portions located on the other side of the second housing;

wherein input ends of the third coil wires are connected to the third soldering portions, and output ends of the third coil wires are connected to the fourth soldering portions;

wherein the circuit board comprises a plurality of third golden fingers electrically connected to the third soldering portions and a plurality of fourth golden fingers electrically connected to the fourth soldering portions; and wherein numbers of the first golden fingers and the second golden fingers are both twelve, and numbers of the third golden fingers and the fourth golden fingers are both eight.

9. The modular connector according to claim 8, wherein the eight third golden fingers are divided into four first groups, and each first group comprises two adjacent third golden fingers;

wherein the twelve second golden fingers comprise four second groups and a plurality of second pads located between adjacent two second groups, and each second group comprises two adjacent second golden fingers; and wherein the third golden fingers of each first group are connected to corresponding second golden fingers of corresponding second group through conductive paths of the circuit board, and the second pads are connected to resistors of the circuit board.

10. The modular connector according to claim 9, wherein the twelve first golden fingers comprise four third groups and a plurality of first pads located between adjacent two third groups, each third group comprises two adjacent first golden fingers, and the first pads are connected to capacitors of the circuit board.

11. The modular connector according to claim 1, wherein each of the first magnetic body, the second magnetic body and the third magnetic body is ring-shaped.

12. A modular connector, comprising:

a housing;

a circuit board mounted to the housing;

a connector assembly comprising a plurality of conductive terminals electrically connected to the circuit board; and a coil module mounted to the circuit board;

wherein the coil module comprises a first coil module and a second coil module, the first coil module comprises a plurality of first coil groups, each first coil group is formed by a first coil and a second coil adjacent to the first coil;

wherein each first coil comprises a ring-shaped first magnetic body and a first coil wire wound on the first magnetic body, and each second coil comprises a ring-shaped second magnetic body and a second coil wire wound on the second magnetic body; and wherein the second coil module comprises a single third coil, the third coil comprises a ring-shaped third magnetic body and a plurality of third coil wires wound on the third magnetic body, the third coil is divided into a plurality of second coil groups along a circumference of the third magnetic body, numbers of the second coil groups and the first coil groups are the same, and the first coil groups and second coil groups are coupled so as to improve an electromagnetic shielding effect of the modular connector.

13. The modular connector according to claim 12, wherein the first coil module comprises four first coils and four second coils, both the first coil groups and the second coil groups comprise four groups.

14. The modular connector according to claim 12, wherein the circuit board comprises a first circuit board and a second circuit board perpendicular to the first circuit board, the connector assembly is mounted to the first circuit board, and the coil module is mounted to the second circuit board.

15. The modular connector according to claim 14, further comprising a transfer module electrically connecting the first circuit board and the second circuit board, the transfer module comprising a plurality of transfer terminals, wherein one end of the transfer terminals is connected to the first circuit board, and the other end of the transfer terminals is connected to the second circuit board.

16. The modular connector according to claim 12, wherein the first coil module comprises a first housing, and the first housing comprises a first receiving space in which the plurality of first coils and the plurality of second coils are received;

wherein the second coil module comprises a second housing, and the second housing comprises a second receiving space in which the third coil is received; and wherein the first housing and the second housing are spaced apart from each other in a vertical direction.

17. The modular connector according to claim 16, wherein the first coil module comprises a plurality of first soldering portions located on one side of the first housing and a plurality of second soldering portions located on the other side of the first housing;

wherein input ends of the first coil wires are connected to the first soldering portions, output ends of the second coil wires are connected to the second soldering portions; and wherein the circuit board comprises a plurality of first golden fingers electrically connected to the first soldering portions and a plurality of second golden fingers electrically connected to the second soldering portions.

18. The modular connector according to claim 17, wherein the second coil module comprises a plurality of third soldering portions located on one side of the second housing and a plurality of fourth soldering portions located on the other side of the second housing;

wherein input ends of the third coil wires are connected to the third soldering portions, and output ends of the third coil wires are connected to the fourth soldering portions;

wherein the circuit board comprises a plurality of third golden fingers electrically connected to the third soldering portions and a plurality of fourth golden fingers electrically connected to the fourth soldering portions; and wherein numbers of the first golden fingers and the second golden fingers are both twelve, and numbers of the third golden fingers and the fourth golden fingers are both eight.

19. The modular connector according to claim 18, wherein the eight third golden fingers are divided into four first groups, and each first group comprises two adjacent third golden fingers;

wherein the twelve second golden fingers comprise four second groups and a plurality of second pads located between adjacent two second groups, and each second group comprises two adjacent second golden fingers; and wherein the third golden fingers of each first group are connected to corresponding second golden fingers of corresponding second group through conductive paths of the circuit board, and the second pads are connected to resistors of the circuit board.

20. The modular connector according to claim 19, wherein the twelve first golden fingers comprise four third groups and a plurality of first pads located between adjacent two third groups, each third group comprises two adjacent first golden fingers, and the first pads are connected to capacitors of the circuit board.

* * * * *